US007861466B2

(12) United States Patent
Sanborn

(10) Patent No.: US 7,861,466 B2
(45) Date of Patent: Jan. 4, 2011

(54) MOUNTING APPARATUS FOR LIGHTING AND LIGHTING ACCESSORIES

(75) Inventor: Ken Sanborn, Longboat Key, FL (US)

(73) Assignee: Secure Design Works, LLC, Bradenton, FL (US)

( * ) Notice: Subject to any disclaimer, the term of this patent is extended or adjusted under 35 U.S.C. 154(b) by 335 days.

(21) Appl. No.: 12/231,830

(22) Filed: Sep. 5, 2008

(65) Prior Publication Data

US 2010/0059646 A1 Mar. 11, 2010

(51) Int. Cl.
*E04B 9/18* (2006.01)

(52) U.S. Cl. ..... 52/39; 52/28; 362/148; 362/404; 248/229.1; 248/229.15; 248/229.2; 248/231.21

(58) Field of Classification Search ..... 52/27, 52/39, 173.1, 28; 248/229.15, 231.21, 231.71, 248/229.1, 229.2, 229.25, 229.26, 229.16; 362/148, 404

See application file for complete search history.

(56) References Cited

U.S. PATENT DOCUMENTS 595,196 A * 12/1897 Newman et al. ..... 211/34
1,476,990 A * 12/1923 McKee ..... 52/39
2,398,306 A * 4/1946 Hermanson ..... 403/385
2,891,296 A * 6/1959 Darde ..... 403/391
3,003,735 A * 10/1961 Havener ..... 248/228.7
3,018,080 A 1/1962 Loudon
3,146,982 A * 9/1964 Budnick ..... 248/68.1
3,589,660 A * 6/1971 Dunckel ..... 248/343
3,618,176 A * 11/1971 Barnes ..... 248/227.4
3,843,086 A * 10/1974 Ptak ..... 248/317
4,112,550 A 9/1978 DeWitt et al.
4,149,693 A * 4/1979 LoNigro ..... 248/342
4,191,352 A * 3/1980 Schuplin ..... 248/317
4,221,355 A * 9/1980 Hoop ..... 248/340
5,104,079 A * 4/1992 Hardtke ..... 248/228.5
5,276,949 A * 1/1994 Cordellini ..... 24/569
5,312,079 A * 5/1994 Little, Jr. ..... 248/230.6
5,361,565 A * 11/1994 Bayer ..... 254/292
5,424,931 A * 6/1995 Wheeler ..... 362/418
5,490,651 A * 2/1996 Kump ..... 248/222.12

OTHER PUBLICATIONS

Lowel, Lowel Clamps & Mounts, available at http://www.lowel.com/clamps.html (viewed on Sep. 3, 2008).

* cited by examiner

*Primary Examiner*—Robert J Canfield
*Assistant Examiner*—Jessie Fonseca
(74) *Attorney, Agent, or Firm*—Law Office of Steven R. Olsen PLLC; Steven R. Olsen

(57) ABSTRACT

Embodiments of the invention provide a mounting apparatus that includes at least two ceiling mounts. Each of two scissor mounts may be coupled to the same or different dropped ceiling rail(s) using a corresponding scissor clip feature. The mounting apparatus further includes a mounting pipe that is coupled to each of the scissor mounts. The mounting pipe is thus suspended by the scissor mounts below the dropped ceiling, providing an unlimited number of potential mounting positions for lighting and/or lighting accessories.

15 Claims, 5 Drawing Sheets

MOUNTING APPARATUS FOR LIGHTING AND LIGHTING ACCESSORIES

BACKGROUND AND SUMMARY

1. Field of the Invention

The invention relates generally to a mounting apparatus, and more particularly, but without limitation, to a mounting apparatus for lighting and lighting accessories that is configured to attach to dropped ceiling rails.

2. Description of the Related Art

Frequently, a photographer or videographer will capture images on location rather than in studio. Location shoots present many challenges for the photographer or videographer. One challenge is finding adequate mounting areas for lighting (lamps) and lighting accessories (e.g., reflectors, umbrellas, and flags).

Many indoor locations include dropped ceilings (a/k/a drop ceilings or suspended ceilings). Such ceilings include an array of panels (or tiles) supported by rails (a/k/a runners, tracks, or beams). Typically, the panels are square. For instance, the panels may be 2 ft square or 600 mm square. Rectangular panels measuring 2 ft×4 ft are also common.

Known mounting devices attach to the rails for the purpose of at least temporarily mounting lighting and/or lighting accessories below the dropped ceiling. Examples include the scissor clip described in U.S. Pat. No. 3,018,080 and the ceiling hook disclosed in U.S. Pat. No. 4,112,550. Both devices can be quickly and easily installed, and their use does not require permanent alteration of (or damage to) the rails.

The scissor clip and ceiling hook described in the foregoing references have many disadvantages, however. For instance, a drawback is that each device only provides a single mounting area. Additionally, the scissor clip and ceiling hook constrain the available mounting positions to those that are directly aligned with the rails of the dropped ceiling.

A portable mounting apparatus is needed that can provide greater flexibility in where a photographer or videographer can mount lighting and lighting accessories.

SUMMARY OF THE INVENTION

Embodiments of the invention seek to overcome one or more of the aforementioned limitations by providing a mounting apparatus that includes at least two ceiling mounts. In an embodiment of the invention, each of two scissor mounts are coupled to the same or different dropped ceiling rail(s) using a corresponding scissor clip feature. The mounting apparatus further includes a mounting pipe that is coupled to each of the scissor mounts. The mounting pipe is thus suspended by the scissor mounts below the dropped ceiling, providing an unlimited number of potential mounting positions for lighting and/or lighting accessories.

An embodiment of the invention provides a mounting apparatus that includes: at least two scissor mounts, each of the at least two scissor mounts having: a scissor clip, the scissor clip configured to couple to a rail of a dropped ceiling; and a shaft coupled to the scissor clip at a first end of the shaft; a pipe coupled to each of the at least two scissor mounts, a long axis of the pipe being substantially orthogonal to a long axis of the shaft; and a first male connector coupled to the pipe and configured to receive one of a lighting fixture and a lighting accessory.

BRIEF DESCRIPTION OF THE DRAWINGS

The present invention will be more fully understood from the detailed description below and the accompanying drawings, wherein.

DETAILED DESCRIPTION

Embodiments of the invention now will be described more fully with reference to FIGS. 1A through 5, in which embodiments of the invention are shown. This invention may, however, be embodied in many different forms and should not be construed as limited to the embodiments set forth herein. Rather, these embodiments are provided so that this disclosure will be thorough and complete.

Figure 1C:
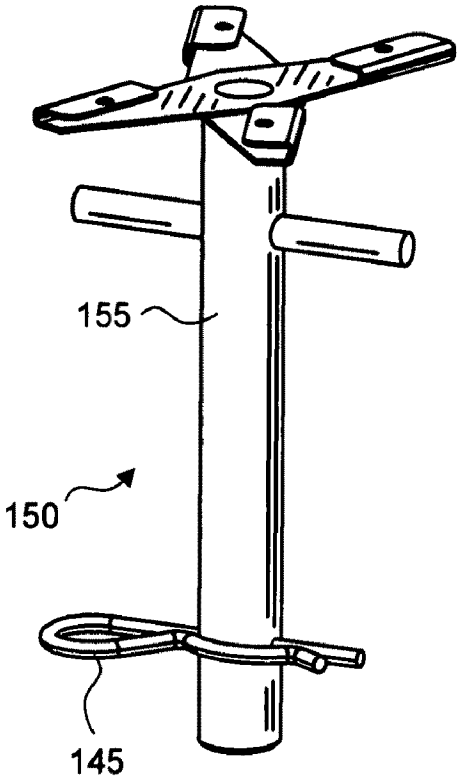
FIG. 1C is a perspective view of a scissor mount and cotter pin, according to an embodiment of the invention.
Figure 1B:
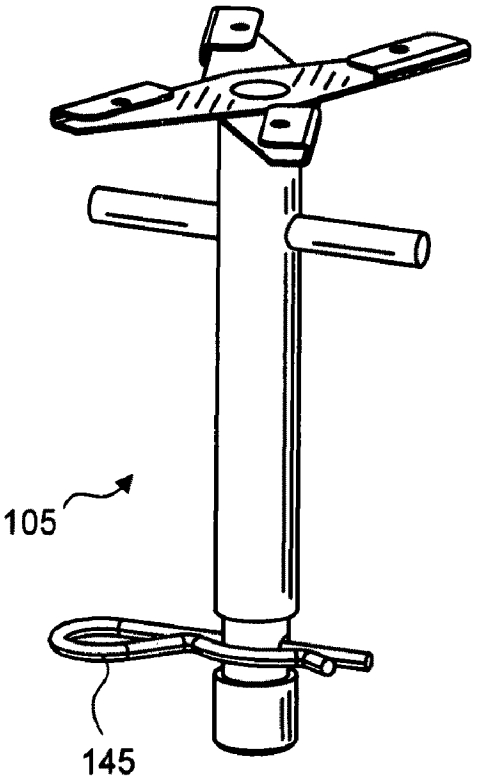
FIG. 1B is a perspective view of a scissor mount and cotter pin, according to an embodiment of the invention.
Figure 1A:
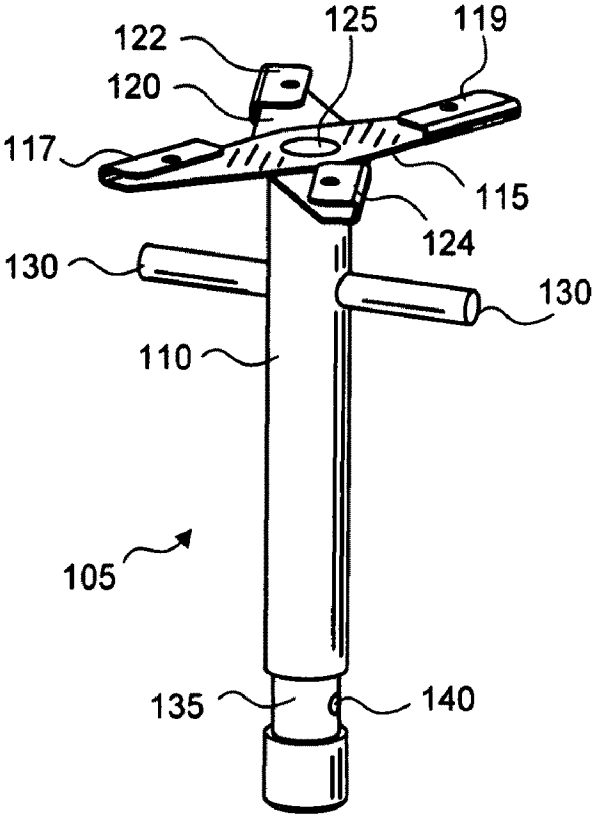
FIG. 1A is a perspective view of a scissor mount, according to an embodiment of the invention.

FIG. 1A is a perspective view of a scissor mount, according to an embodiment of the invention. As illustrated therein, a scissor mount 105 includes a shaft 110. The shaft 110 may be manufactured, for example, from solid aluminum round bar stock.

On a top end of the scissor mount 105, a scissor clip is formed by an arm 115 and an arm 120 that rotate about a pivot point 125. The arm 115 includes flanges 117 and 119 extending upward and inward from opposite ends and sides of the arm 115. The arm 120 includes flanges 122 and 124 extending upward and inward from opposite ends and sides of the arm 120. The scissor clip is configured such that it can be locked in a closed position, communicating with a dropped ceiling rail on interior surfaces of the flanges 117, 119, 122, and 124. The scissor mount 105 may further include a handle 130. The handle 130 may be manufactured, for example, from solid aluminum round bar stock. In operation, the handle 130 may be used to rotate the shaft 110 for the purpose of loosening or tightening the scissor clip. U.S. Pat. No. 3,018,080, issued Jan. 23, 1962, is hereby incorporated by reference in its entirety for its disclosure of the scissor clip mechanism.

A bottom portion of the shaft 110 may include a reduced-diameter portion 135 that forms a male stud connector on the bottom portion of the shaft 110. The shaft 110 may further include a through-hole 140 in the bottom portion of the shaft 110, although the through-hole 140 does not necessarily have to pass through the reduced-diameter portion 135.

FIG. 1B is a perspective view of a scissor mount and cotter pin, according to an embodiment of the invention. FIG. 1B illustrates that the through-hole 140 of the scissor mount 105 is configured to receive a cotter pin 145. The purpose of the cotter pin 145 will be described below with reference to FIGS. 2 and 4.

FIG. 1C is a perspective view of a scissor mount and cotter pin, according to an embodiment of the invention. FIG. 1C illustrates a scissor mount 150 that is substantially similar to the scissor mount 105 illustrated and described above with reference to FIGS. 1A and 1B, except that the scissor mount 150 does not include the reduced diameter area 135 or the associated male connector. FIG. 1C also illustrates that the through-hole 140 of the scissor mount 150 is configured to receive the cotter pin 145.

Variations to the scissor mounts 105 and 150 are also possible. For instance, the materials and proportions of the scissor mounts 105 and 150 could be varied, according to design choice. Moreover, in alternative embodiments, the handle 130 could be omitted.

Figure 2:
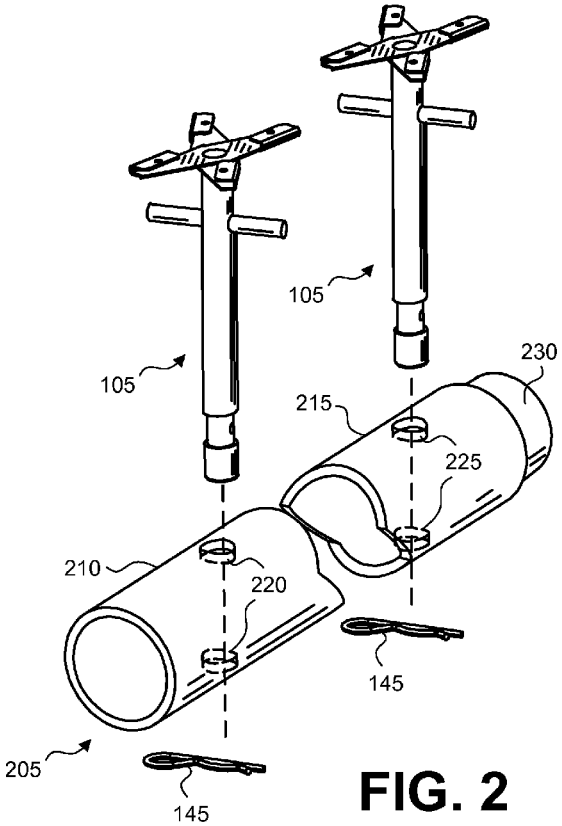
FIG. 2 is an exploded perspective view of a pipe assembly, according to an embodiment of the invention.

FIG. 2 is an exploded perspective view of a pipe assembly, according to an embodiment of the invention. The illustrated pipe assembly includes a pipe 205. The pipe 205 may be, for example, a hollow aluminum tube. The long dimension of the pipe 205 could be, for instance, 6 or 10 ft, and the pipe 205 could have an outside diameter of approx. 1 5/16 inches, although the scope of the invention is not limited to these exemplary dimensions. A first portion 210 of the pipe 205 includes a pair of opposing through-holes 220; a second portion 215 of the pipe 205 includes a pair of opposing through-holes 225. Each pair of through-holes 220 and 225 is configured to receive the shaft 110 of a scissor mount 105. The pipe 205 is retained on the pair of scissor mounts 105 by the cotter pins 145.

Variations to the pipe assembly illustrated in FIG. 2 and described above are possible. For example, the pipe 205 may be constructed of iron, plastic, wood, carbon fiber, titanium, or other suitable material. In alternative embodiments, the pipe 205 could be solid rather than hollow. Furthermore, the pipe 205 may be configured with more than two pairs of through-holes to accept more than two scissor mounts 105 and/or other components.

In yet another embodiment, the pipe 205 could be telescopic to enhance portability. For instance, the pipe 205 could be 4 ft long in its most compressed configuration, but 7 ft long when fully extended. Because different portions of a telescoping pipe 205 may overlap, there may be a discrete number of adjustable lengths that could be accommodated (to account for overlap of the through-hole pairs). The optional telescope feature of the pipe 205 is illustrated in FIG. 2 by the pipe portion 230 that is configured to cooperate with the pipe portion 215.

Figure 3:
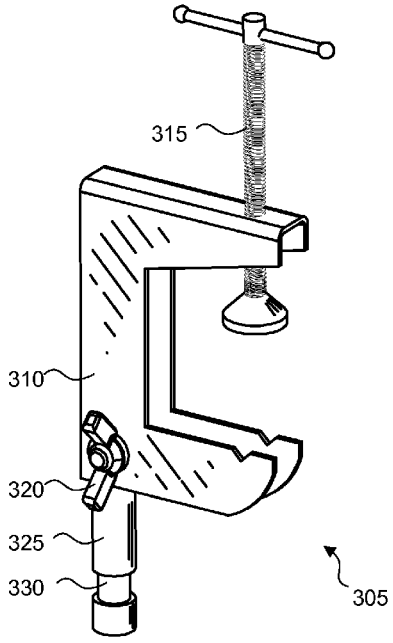
FIG. 3 is a perspective view of a c-clamp, according to an embodiment of the invention.

FIG. 3 is a perspective view of a c-clamp, according to an embodiment of the invention. A shown therein, the c-clamp 305 includes a c-shaped frame 310. The frame 310 may be manufactured from steel, cast iron, aluminum, or other suitable material. A special-purpose screw 315 threads through a first portion of the frame 310 to provide clamping action between a flat end of the special-purpose screw 315 and a second portion of the frame 310. A shaft 325 coupled to the frame 310 may include a reduced diameter portion 330 to form a male stud connector on a bottom end of the shaft 325. A wing nut assembly 320 may also be attached to the frame 310 to facilitate the attachment of flags or other lighting accessories.

Figure 4A:
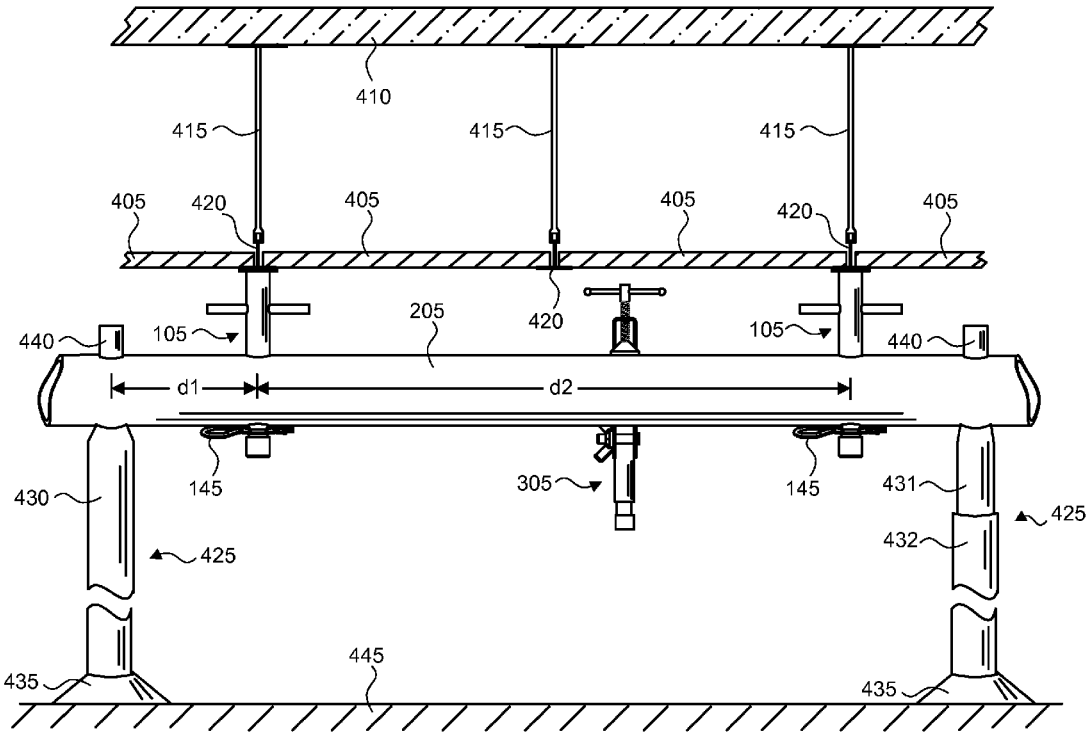
FIG. 4A is an elevation view of a mounting apparatus, according to an embodiment of the invention.

FIG. 4A is an elevation view of a mounting apparatus, according to an embodiment of the invention. In FIG. 4A, a structural deck 410, panels 405, and a floor 445 are illustrated in cross-section. The structural deck 410 may be or include, for instance, a joist, ceiling, or other architectural features that can provide adequate support for a dropped ceiling.

The dropped ceiling includes the panels 405, which are suspended from the structural deck 410 via cables 415 and rails 420. The panels 405 may be constructed of plastic, wood, metal, fiber board, or other suitable material. In an alternative embodiment, the cables 415 may be substituted by rods (not shown). Typically, the rails 420 have an inverted T cross-section (as illustrated). The cables 415, rods (not shown), and rails 420 may be metal, plastic, or other suitable material, according to design choice.

The mounting apparatus may include components already described herein. Accordingly, in the illustrated embodiment, the mounting apparatus includes a pipe 205 that is coupled to two scissor mounts 105 with cotter pins 145, as described above with reference to FIG. 2. Each of the two scissor mounts 105 is attached to a respective rail 420 via the scissor clip feature. As shown, the mounting apparatus also includes a c-clamp 305 coupled to the pipe 205 to accommodate lighting and/or lighting accessories that are compatible with the male stud connector of the c-clamp 305.

In the illustrated embodiment, the mounting apparatus further includes two poles 425. Each of the two poles 425 is optional, and any number of poles 425 could be used. One benefit of the poles 425 is additional support for the weight of the pipe 205 and the lighting and/or lighting accessories that could be mounted to the pipe 205. The poles 425 could also provide additional mounting locations for lighting and/or lighting accessories. Each of the two poles 425 illustrated in FIG. 4A includes a tubular body 430 or 431/432. The tubular body 430 or 431/432 tapers to a reduced diameter tip 440 at one end, and terminates into a foot 435 at an opposite end. As illustrated in FIG. 4A, the pole 425 may include a first tubular body portion 431 that is configured to cooperate with a second tubular body portion 432 to provide telescopic adjustment between the pipe 205 and the floor 445. Preferably, the reduced diameter tip 440 of the pole 425 is configured to communicate with the same diameter through-hole pairs in the pipe 205 as the scissor mounts 105 and/or 150. The foot 435 may be or include, rubber, for example, to provide friction with the surface of the floor 445.

Variations to the mounting apparatus illustrated in FIG. 4A are possible. For instance, the pipe 205 could include more than the 4 illustrated pairs of through-holes, and the positioning of each through-hole pair is not constrained by the exemplary dimensions d1 and d2. Indeed, for some applications, it may be preferable that the through-hole pairs in the pipe 205 are spaced at regular intervals that are approximately equal to spacing between the rails 420.

More than two scissor mounts 105 could be used with the pipe 205. It may be advantageous in some cases to include more scissor mounts 105 per unit length of the pipe 205 to improve the weight-bearing ability of the mounting apparatus. In an alternative embodiment, one or more scissor mounts 150, and/or other dropped ceiling mounts not disclosed herein could be used to suspend the pipe 205 from the rails 420.

Fasteners other than cotter pins 145 could be used to fasten the pipe 205 to the scissor mounts 105, 150, or other ceiling mounts. For example, nuts and bolts could be used in place of the cotter pins 145.

The placement of a single c-clamp 305 in FIG. 4A is merely illustrative. Multiple c-clamps 305 could be affixed to the pipe 205. In the alternative, or in combination, one or more other pieces of mounting hardware could be coupled to the pipe 205 to facilitate the attachment of lighting and/or lighting accessories to the pipe 205.

Figure 4B:
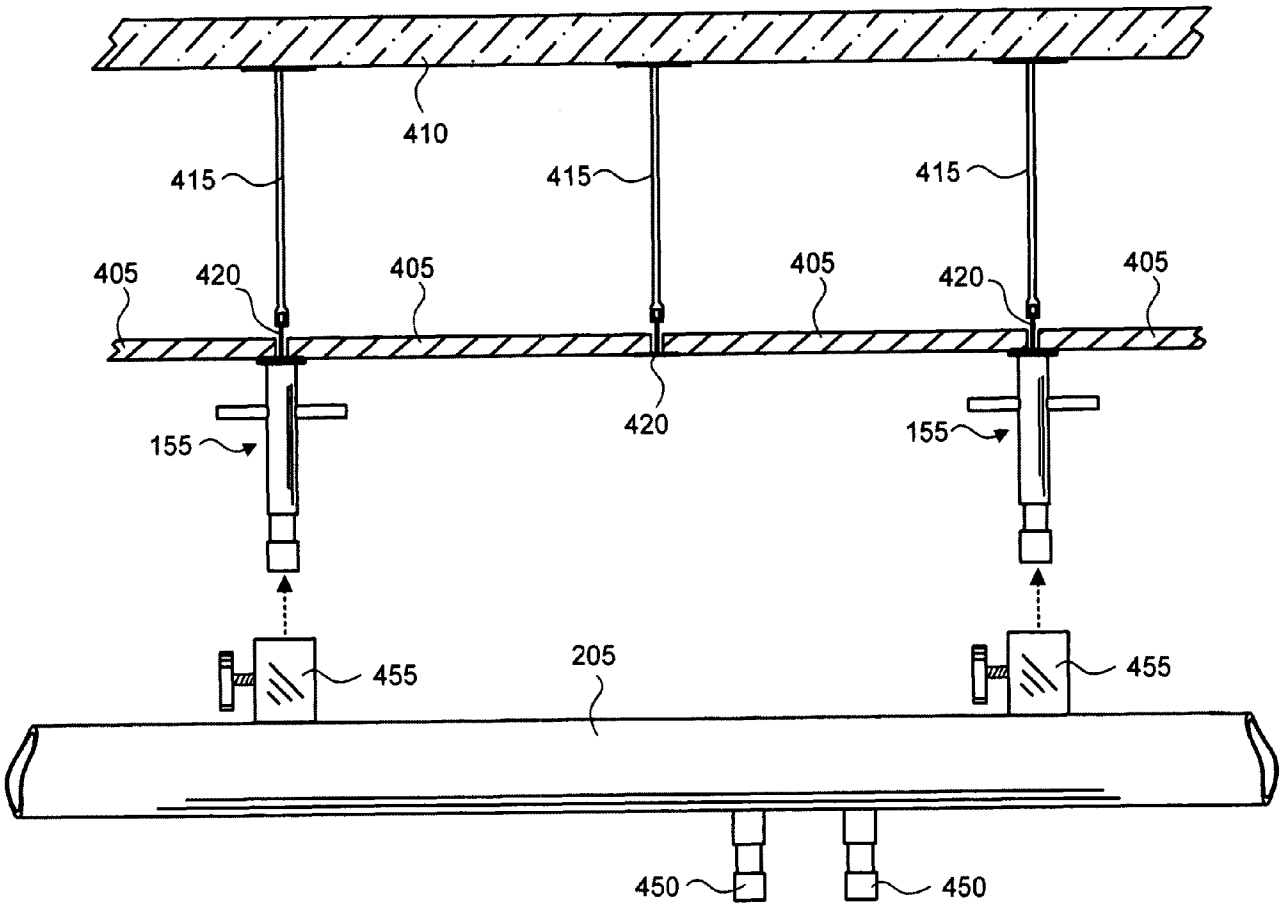
FIG. 4B is an elevation view of a mounting apparatus, according to an embodiment of the invention.

FIG. 4B is an elevation view of a mounting apparatus, according to an embodiment of the invention. The embodiment illustrated in FIG. 4B is substantially similar to mounting apparatus configuration illustrated in FIG. 4A, except as described below.

In FIG. 4B, male connectors 450 are directly attached to the pipe 205. One or more directly-attached male connectors 450 could therefore be used alone or in combination with one or more c-clamps 305 to mount lighting and/or lighting accessories to the mounting apparatus.

FIG. 4B also illustrates scissor mounts 155. Scissor mounts 155 are substantially similar to the scissor mounts 105, except that scissor mounts 155 lack a through-hole 140. In the illustrated embodiment, the pipe 205 includes two female connectors 455 that are configured to mate with corresponding male connectors located on an end of each scissor mount 155. FIG. 4B thus shows a coupling technique that can be used in the alternative to the cotter pin retaining scheme illustrated in FIGS. 2 and 4A.

Figure 5:
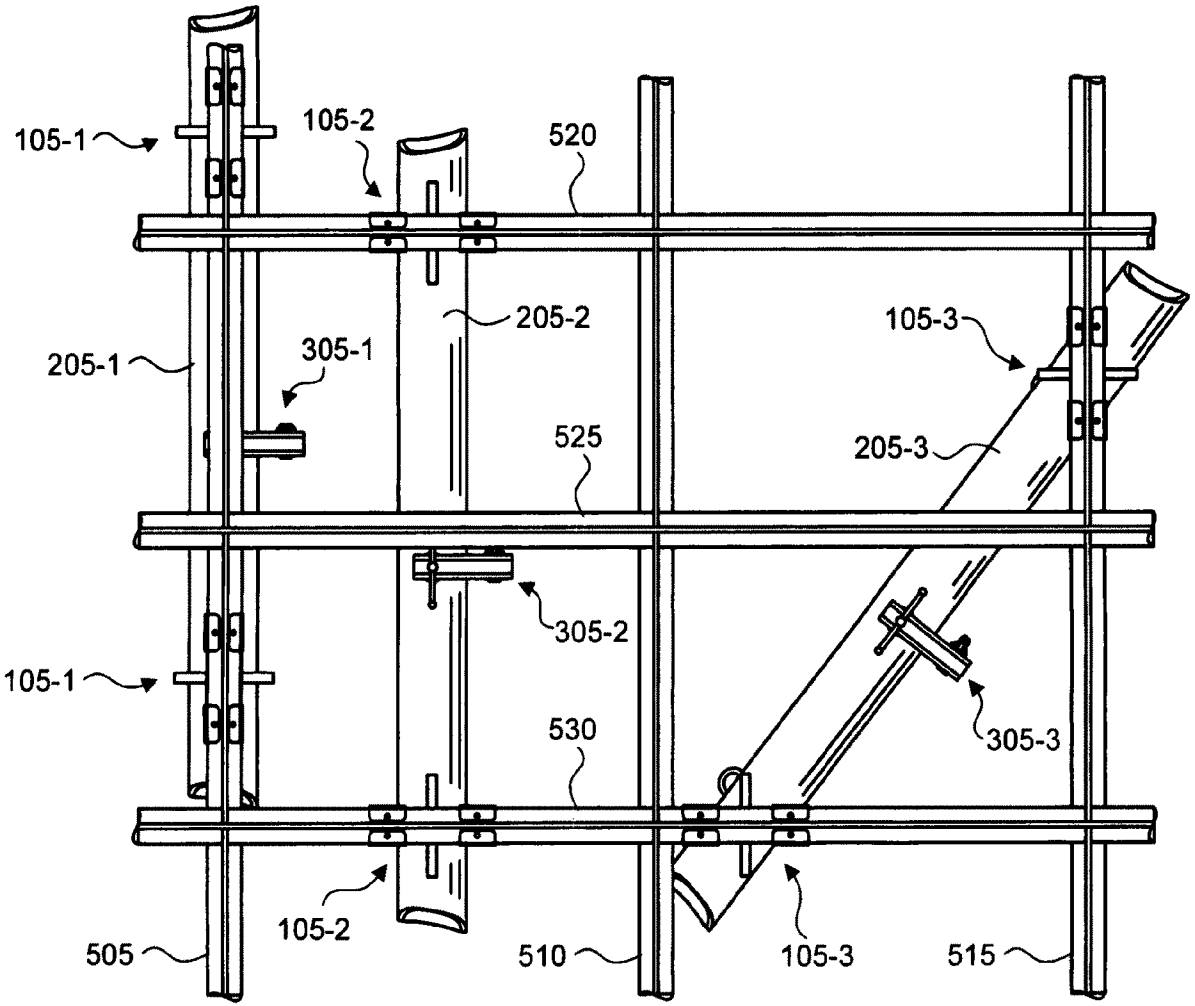
FIG. 5 is a top plan view of multiple mounting apparatuses, according to an embodiment of the invention.

FIG. 5 is a top plan view of multiple mounting apparatuses, according to an embodiment of the invention. For clarity, cables 415 and panels 405 are not shown. The only dropped ceiling features shown in FIG. 5 are rails 505, 510, 515, 520, 525, and 530. More specifically, rails 505, 510, and 515 are substantially parallel to each other and extend in a first direction. Rails 520, 525, and 530 are substantially parallel to each other and extend in a second direction. The first direction is substantially orthogonal to the second direction, as is typical in dropped ceiling installations. Together, the rails 505, 510, 515, 520, 525, and 530 represent at least a portion of a dropped ceiling rail grid.

FIG. 5 further illustrates at least portions of three mounting apparatuses that are coupled to the rail grid. Each of the mounting apparatuses is attached to the rail grid in a unique fashion. A first mounting apparatus includes a pipe 205-1, two scissor mounts 105-1, and a c-clamp 305-1. The first mounting apparatus is coupled to a single rail 505. A second mounting apparatus includes a pipe 205-2, two scissor mounts 105-2, and a c-clamp 305-2. The second mounting apparatus is coupled to parallel rails 520 and 530, similar to the configurations in FIGS. 4A and 4B. A third mounting apparatus includes a pipe 205-3, two scissor mounts 105-3, and a c-clamp 305-3. The third mounting apparatus is coupled to orthogonal rails 515 and 530. The alternative couplings illustrated in FIG. 5 thus underscore the flexibility in attaching one or more of the disclosed mounting apparatuses to a rail grid of a dropped ceiling.

Each of the possible variations discussed with reference to the mounting apparatus in FIGS. 4A and 4B are also possible, separately or in combination, with respect to each of the mounting apparatuses depicted in FIG. 5.

It will be apparent to those skilled in the art that additional modifications and variations can be made without deviating from the spirit or scope of the invention. For example, a mounting apparatus could be formed using two or more devices disclosed herein in combinations that are not expressly illustrated or otherwise disclosed. Moreover, any combination of devices described herein could be included in a kit for later assembly into a mounting apparatus at a remote location. It is intended that the invention cover any such modifications and variations of this invention provided they come within the scope of the appended claims and their equivalents.

What is claimed is:

1. A mounting apparatus comprising:

at least two scissor mounts, each of the at least two scissor mounts having:

a scissor clip, the scissor clip configured to couple to a rail of a dropped ceiling; and a shaft coupled to the scissor clip at a first end of the shaft;

a pipe coupled to each of the at least two scissor mounts, a long axis of the pipe being substantially orthogonal to a long axis of the shaft, the pipe including at least two pairs of opposing through-holes, each of the at least two pairs of opposing through-holes configured to receive the shaft of a corresponding one of the at least two scissor mounts;

a first male connector coupled to the pipe and configured to receive one of a lighting fixture and a lighting accessory; and at least two cotter pins, the shaft including a through-hole at a second end of the shaft, the through-hole configured to receive a corresponding one of the at least two cotter pins, the at least two cotter pins thus configured to retain the pipe on the shaft of each of the at least two scissor mounts.

2. The mounting apparatus of claim 1, wherein the pipe is constructed of aluminum.

3. The mounting apparatus of claim 1, wherein the pipe is telescopic.

4. The mounting apparatus of claim 1, further comprising a c-clamp clamped to the pipe, the first male connector being a portion of the c-clamp.

5. The mounting apparatus of claim 1, wherein the first male connector is directly affixed to the pipe.

6. The mounting apparatus of claim 5, further comprising a c-clamp clamped to the pipe, the c-clamp having a second male connector.

7. The mounting apparatus of claim 1, further comprising at least one pole coupled between the pipe and a floor.

8. The mounting apparatus of claim 7, wherein the at least one pole includes a reduced-diameter tip with respect to a body of the pole, the reduced-diameter tip being in direct communication with the pipe.

9. The mounting apparatus of claim 8, wherein the reduced-diameter tip has substantially the same diameter as the shaft.

10. The mounting apparatus of claim 7, wherein the at least one pole includes a rubber foot, the rubber foot being in direct communication with a surface of the floor.

11. The mounting apparatus of claim 7, wherein the at least one pole is telescopic.

12. The mounting apparatus of claim 1, wherein two of the at least two scissor mounts are coupled to the same rail of the dropped ceiling.

13. The mounting apparatus of claim 1, wherein a first one of the at least two scissor mounts is coupled to a first rail of the dropped ceiling, a second one of the at least two scissor mounts is coupled to a second rail of the dropped ceiling, the first rail being substantially parallel to the second rail.

14. The mounting apparatus of claim 1, wherein a first one of the at least two scissor mounts is coupled to a first rail of the dropped ceiling, a second one of the at least two scissor mounts is coupled to a second rail of a dropped ceiling, the first rail being substantially orthogonal to the second rail.

15. A lighting system comprising:

a first mounting apparatus as claimed in claim 1;

a dropped ceiling rail grid coupled to the first mounting apparatus; and a second mounting apparatus as claimed in claim 1, the second mounting apparatus coupled to the dropped ceiling rail grid.

* * * * *